United States Patent [19]

Ficurilli

[11] 4,300,316

[45] Nov. 17, 1981

[54] SASH BALANCE FOOT SEAL MECHANISM

[75] Inventor: Nicholas Ficurilli, Rochester, N.Y.

[73] Assignee: Schlegel Corporation, Rochester, N.Y.

[21] Appl. No.: 85,770

[22] Filed: Oct. 17, 1979

[51] Int. Cl.[3] ..... E05D 13/10

[52] U.S. Cl. ..... 49/445; 49/493

[58] Field of Search ..... 49/445, 446, 490, 493

[56] References Cited

U.S. PATENT DOCUMENTS

| | | | |
|---|---|---|---|
| 2,294,851 | 9/1942 | Owen | 49/445 X |
| 2,688,165 | 9/1954 | Kinish | 49/493 X |
| 2,720,685 | 10/1955 | Harris | 49/493 X |
| 2,902,732 | 9/1959 | Beck | 49/493 |
| 2,952,048 | 9/1960 | Graham | 49/446 |
| 3,091,797 | 6/1963 | Prosser | 49/445 X |
| 3,385,001 | 5/1968 | Bordner | 49/490 X |
| 3,482,354 | 12/1969 | Trout | 49/446 X |

*Primary Examiner*—Philip C. Kannan

*Attorney, Agent, or Firm*—Cumpston & Shaw

[57] ABSTRACT

The object of this invention is to provide a sash balance foot seal mechanism for sealing the space between each side of a window sash and the adjacent window jamb or jamb liner.

Each sash balance foot seal mechanism has a foot seal comprising a flat resilient member into which the ends of a metal catch member are embedded. The catch member secures the foot seal to the sash balance mechanism. Each foot seal has a depending projection for sealing a complementary slot in each side of the sash. Each foot seal further has a low friction seal coating at least on the surface slidably engaging the jamb or jamb liner.

8 Claims, 7 Drawing Figures

SASH BALANCE FOOT SEAL MECHANISM

DESCRIPTION

1. Technical Field

This invention relates to window weather seals, and particularly to a sash balance foot seal mechanism for a window.

In windows, particularly double hung windows, it is essential to provide sufficient space between the sides of the sashes and the jambs to allow slidable movement of the sashes between open and closed positions without binding. Such space allows the leakage of air, moisture, sound and foreign matter from the outside atmosphere through the closed sashes into an adjacent room.

2. Background Art

It is known in the prior art to provide a window with a sash balance mechanism for counterbalancing the weight of the sash. The sash balance mechanism comprises a spring having one end secured to a fixed member and a pulley secured to the free end. The spring is coupled to a stamped metal foot member having a pulley secured thereto by a sash cord extending over the pulleys. The spring biases a metal face of the foot member into engagement with the lower rail of the window for counterbalancing the weight of the sash. The stamped metal foot member has a resilient coating on its opposite face forming a bumper for the sash.

3. Disclosure of the Invention

In accordance with the present invention, a sash balance foot seal mechanism is disclosed for sealing the space between the sides of a sash and the window jambs when the sash is closed to substantially eliminate any leakage therethrough of air, moisture, sound, foreign matter or the like.

The sash balance foot seal mechanism comprises a foot seal of a substantially flat resilient material for sealing the space between a side of the sash and the window jamb. A metal catch member has the ends thereof embedded in the resilient material to form a catch for securing the foot seal to the sash balance mechanism.

Each foot seal has a depending projection projecting into and sealing a complementary groove along the side surface of the sash. Each foot seal further has a low friction coating at least on the surface engaging the jamb or jamb liner.

One of the advantages of the sash balance foot seal mechanism of this invention is that it achieves the dual function of (1) counterbalancing the weight of the sash and (2) sealing the space between a side of the sash and the window jamb or jamb liner when the sash is closed to substantially eliminate any leakage therethrough of air, moisture, sound, foreign matter or the like.

BRIEF DESCRIPTION OF THE DRAWINGS

The details of the invention will be described in connection with the accompanying drawings, in which.

DESCRIPTION OF THE INVENTION

Figure 1:
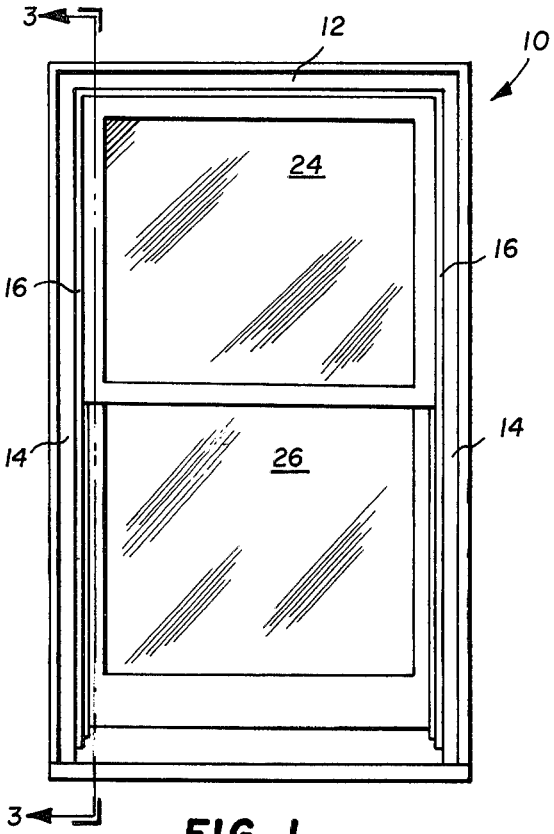
FIG. 1 is a front elevational view of a double hung window containing jamb liners in which the sash balance foot seal mechanism of this invention is incorporated.

Referring to FIG. 1 of the drawings, a double hung window 10 of standard type is disclosed in which the sash balance foot seal mechanism of this invention is incorporated. The window 10 includes a frame 12 having side jambs 14 onto which jamb liners 16 are mounted. Each jamb liner supports a sash balance foot seal mechanism to be described hereinafter. Although the invention is illustrated in a double hung window 10, it is equally applicable to a single hung window. Also, the sash balance foot seal mechanisms can be mounted directly on the jambs 14.

Figure 2:
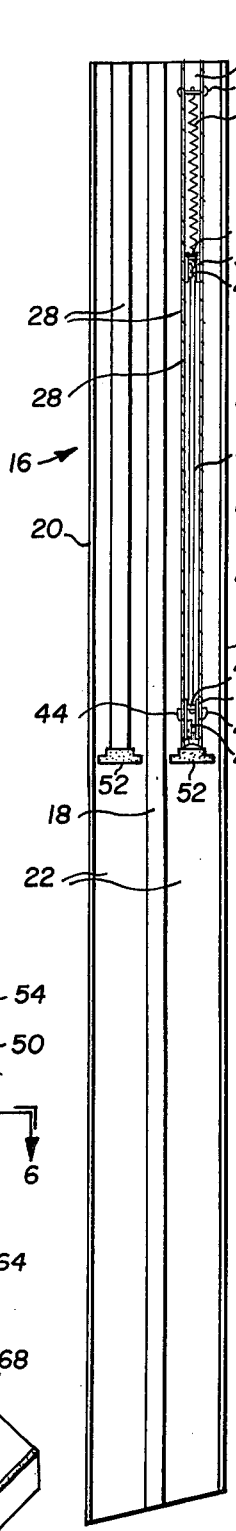
FIG. 2 is an enlarged front elevational view of a jamb liner of the window of FIG. 1 in which a pair of sash balance foot seal mechanisms are incorporated and with a housing of the liner broken away to show one of the sash balance foot seal mechanisms.
Figure 3:
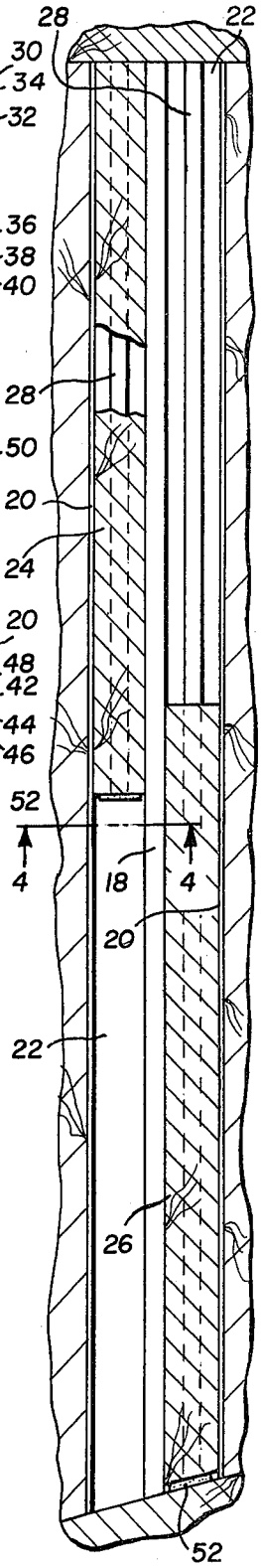
FIG. 3 is a section view taken substantially along line 3—3 of FIG. 1 with portions of the sash broken away.
Figure 4:
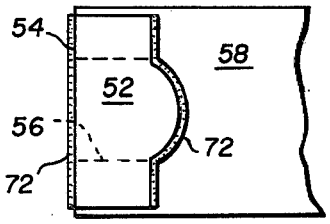
FIG. 4 is an enlarged view of the upper sash and foot seal taken substantially from line 4—4 of FIG. 3.
Figure 5:
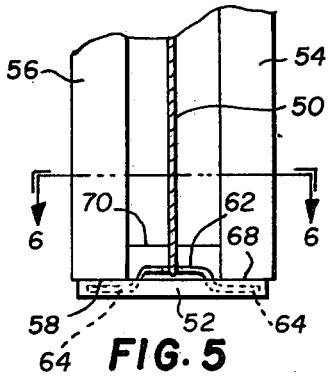
FIG. 5 is a fragmentary enlarged side elevational view of the lower end of the upper sash showing the foot seal.
Figure 6:
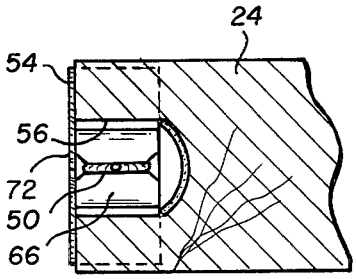
FIG. 6 is a section view taken substantially along line 6—6 of FIG. 5.

Each jamb liner 16, as best illustrated in FIG. 2, comprises a metal or plastic weather strip member of bowed cross section that extends the full length of jamb 14 and is secured thereto by any suitable means. The liner 16 has a longitudinally extending projection 18 intermediate the upturned side edges 20 thereof to form two parallel channels 22 for slidably receiving the sides of upper and lower sashes 24, 26 respectively. The upper half of the liner 16 further has a pair of longitudinally extending raised housings 28 secured in each channel intermediate a side edge 20 of the liner and the center projection 18 and of a length slightly shorter than the height of a sash 24, 26. Each housing 28 has a recessed center portion 30 for housing a sash balance assembly of conventional type.

Each sash balance assembly as best seen in FIG. 2 comprises a spring 32 having a hook at one end secured to a pin 34 riveted to the upper end of a housing 28. The other end of spring 32 has a hook secured to a pin 36 at one end of a free bracket 38. The opposite end of the bracket rotatably supports a double pulley 40. Another bracket 42 is secured to the opposite end of housing 28 by any suitable means such as fins 44 extending through complementary openings in housing 28. The bracket 42 rotatably supports a lower double pulley 46 and a fixed upper pin 48. A sash cord 50 has one end secured to pin 48, an intermediate portion extending over pulleys 40, 46, and its opposite end secured to a foot seal 52. The spring 32, cord 50 and pulleys 40, 46 form a block and tackle arrangement for urging foot seal 52 under spring tension into engagement with the lower end of housing 28 when the sashes 24, 26 are not slidably mounted in the jamb liners 16.

With reference to FIGS. 3–6, the relation between the sash balance foot seal mechanisms and the upper and lower sashes 24, 26 respectively is illustrated with the sashes closed. Each side 54 of each sash is provided with an elongated groove 56 for slidably acommodating a complementary housing 28 in the jamb liner 16. When the sashes 24, 26 are slidably mounted within channels 22, the lower rail surface 58 of each sash is moved into engagement with a complementary foot seal 52. When the lower sash 26 is slidably moved to its closed position, the foot seal 52 and cord 50 of the sash balance assembly is substantially fully extended and the spring 32 further tensioned for applying sufficient force to the sash to counter-balance its weight. In the closed position of the upper sash 24, the foot seal 52 is in sealing engagement with the lower cross rail surface 58. Although the sash balance assembly is only slightly extended, sufficient force is applied to the sash 24 to hold it in its closed position. In each case, the foot seal 52 seals the space between the side surfaces 54 of the sashes 24, 26 and the complementary channel surfaces of the jamb liners 16. This prevents leakage of air, moisture, sound, foreign matter or thelike from the outside atmosphere through this space into an adjacent room when the sashes 24, 26 are closed.

Figure 7:
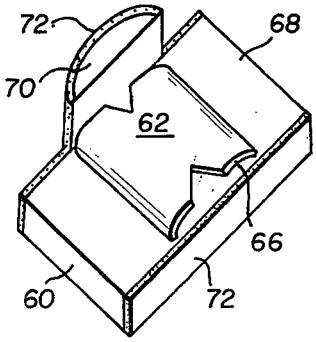
FIG. 7 is a perspective view of the foot seal.

To maximize the sealing effect of foot seal 52, it is preferably constructed as best illustrated in FIG. 7. The foot seal 52 comprises a substantially rectangular base 60 formed from any suitable resilient material such as a polymeric material, for example. The material should be closed celled to prevent water absorption and sufficiently stabilized against ultra violet, ozone and oxidation degradation. In addition, the material should possess the mechanical properties of good resistance to abrasion, tear and compression set.

The foot seal 52 is further provided with a substantially inverted U-shaped steel catch member 62 having the laterally extending ends 64 thereof embedded in the resilient material. The U-shaped mid-portion 66 of the catch member is spaced from base 60 to provide a catch to which one end of sash cord 50 is secured.

The base 60 of foot seal 52 has a flat surface 68 for engaging the end of lower cross rail surface 58 and sealing the end of a sash groove 56. The foot seal 52 further has a resilient projection 70 extending from base 60 into groove 56 and having an outer shape or configuration conforming to the shape or configuration of the deep end of the groove to effectively extend into and seal the entire opening into the groove. This is particularly desirable for a lower sash 26 in which the beveled surface of the lower rail has a slot, not shown, along the entire width of the rail for receiving a cross member weatherstrip, not shown.

To further enhance the sealing ability of foot seal 52, a low friction coating 72 is placed on any surface of the foot seal that engages a surface of jamb liner 16 or rail 58. The low friction coating 72 is formed of any suitable material such as urethane, hypalon, fabric, flocking or the like. The coating 72 is placed on any surface of foot seal 52 such as a side surface or projection surface by any suitable means such as cementing, bonding or the like.

The invention has been described in detail with particular reference to preferred embodiments, but it will be understood that variations and modifications can be effected within the spirit and scope of the invention as described.

I claim:

1. A sash balance foot seal mechanism for sealing the space between a window jamb and a side of a window sash slidably mounted on the jamb for reciprocal movement comprising:

a balance assembly interposed between said jamb and said sash, said balance assembly having a foot seal member engageable by the sash, and a spring connected to said foot seal member for biasing said foot seal member into sealing engagement with said sash, said foot seal member further being formed from a resilient material and shaped to seal the space between said jamb and said sash.

2. The sash balance foot seal mechanism according to claim 1 wherein a surface of said foot seal member is in sliding engagement with a surface of said jamb, and a low friction coating is secured to said surface of said foot seal member.

3. The sash balance foot seal mechanism according to claim 1 wherein said foot seal member has a flat substantially rectangular base, and a resilient projection depending from said base and extending into said space between said jamb and sash.

4. The sash balance foot seal mechanism according to claim 1 wherein a jamb liner is mounted on said jamb, said balance assembly is mounted on said jamb liner, said balance assembly having an outwardly and longitudinally extending housing, said side of said sash having a longitudinally extending groove for receiving said housing, and said foot seal member seals the space between surfaces of said jamb liner and said groove.

5. The sash balance foot seal mechanism according to claim 4 wherein a surface of said foot seal member is in sliding engagement with a surface of said jamb liner, and a low friction coating is secured to said surface of said foot seal member.

6. The sash balance foot seal mechanism according to claim 4 wherein said foot seal member has a flat substantially rectangular base, and a resilient projection depending from said base and extending into said groove.

7. A foot seal member for use in sealing the space between a window jamb and a side of a window sash comprising a substantially flat rectangular base formed of a resilient material, said base having a resilient projection of substantially semi-circular cross section extending from one side of said base at right angles to said base, and a catch member comprising a substantially inverted U-shaped band having a midportion spaced from and parallel to said base to define a catch, and having laterally extending opposite ends of said band parallel to and embedded in said base.

8. The foot seal member according to claim 7 wherein a low friction coating is applied to at least one surface of said foot seal member.

* * * * *